US010950967B2

(12) United States Patent
Probert et al.

(10) Patent No.: US 10,950,967 B2
(45) Date of Patent: Mar. 16, 2021

(54) ELECTRIC TERMINAL HOUSING WITH A TERMINAL LOCK

(71) Applicant: Lear Corporation, Southfield, MI (US)

(72) Inventors: Deborah Probert, Farmington Hills, MI (US); Martin Komorniczak, Remscheid (DE); Yasin Canol, Remscheid (DE); Marlon Christian Grosser, Remscheid (DE); Bhupinder Rangi, Novi, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 10 days.

(21) Appl. No.: 16/383,991

(22) Filed: Apr. 15, 2019

(65) Prior Publication Data

US 2020/0328551 A1 Oct. 15, 2020

(51) Int. Cl.

| | |
|---|---|
| ***H01R 13/40*** | (2006.01) |
| ***H01R 13/436*** | (2006.01) |
| ***H01R 13/502*** | (2006.01) |

(52) U.S. Cl.

CPC ..... *H01R 13/4364* (2013.01); *H01R 13/502* (2013.01)

(58) Field of Classification Search

CPC ..... H01R 13/40; H01R 13/42; H01R 13/436; H01R 13/4364; H01R 13/4365; H01R 13/502

USPC ..... 439/595–752

See application file for complete search history.

(56) References Cited

U.S. PATENT DOCUMENTS

| | | | | |
|---|---|---|---|---|
| 7,625,251 | B2 | 12/2009 | Martin et al. | |
| 7,841,913 | B2 | 11/2010 | Hitchcock et al. | |
| 9,318,841 | B2 * | 4/2016 | Gimbel | H01R 13/5202 |
| 9,935,389 | B1 * | 4/2018 | Irish | H01R 13/4365 |
| 10,050,381 | B2 * | 8/2018 | Wolter | H01R 13/506 |
| 10,181,679 | B1 | 1/2019 | Probert et al. | |

FOREIGN PATENT DOCUMENTS

EP 3171459 A1 5/2017

* cited by examiner

*Primary Examiner* — Khiem M Nguyen

(74) *Attorney, Agent, or Firm* — MacMillan, Sobanski & Todd, LLC

(57) ABSTRACT

An electric terminal housing includes a terminal cavity. The terminal cavity extends along a cavity axis from an insertion end to a mate end. The terminal cavity is adapted to hold an electric terminal. The terminal housing includes a terminal lock. The terminal lock includes a resilient arm that extends from the housing into the terminal cavity. The terminal lock includes a rib that extends from the arm toward the cavity axis.

20 Claims, 7 Drawing Sheets

ELECTRIC TERMINAL HOUSING WITH A TERMINAL LOCK

BACKGROUND OF THE INVENTION

This invention relates to a housing for an electric terminal. More specifically, this invention relates to a housing for an electric terminal including a terminal lock for retaining the electric terminal.

Electric terminals are used in a variety of applications where it is desirable to create an electric connection between various components of a circuit. Wires are connected to electric terminals, and pairs of terminals may be mated to establish an electric circuit. Electric terminals are typically installed in a housing for ease of use. The electric terminals are located in cavities in the housing, and each of the electric terminals is held in a desired position and orientation to allow a user to easily connect multiple electric terminals to respective mating terminals.

The housing includes terminal locks that respectively retain the electric terminals in their installed positions. Typically, each terminal lock includes a resilient member that deflects as the electric terminal is inserted into the housing and rebounds when the electric terminal has been moved to the installed position in order to retain the electric terminal in the housing. The terminal lock resists the electric terminal being pulled out of the housing, such as when a force is applied to the wire connected to the electric terminal. The amount of the force that the terminal lock is designed to resist may vary with the intended use of the electric terminal. Typically, the strength of the terminal lock can be increased by making the lock physically larger.

Conventional vehicles, such as passenger cars, include an increasing number and variety of electric components. As a result, there is a desire to fit a larger number of electric terminals in the limited space available, and it is desirable to position electric terminals as close to each other as possible. Thus, it is desirable that the cavities be small and close to each other, which limits the amount of space available for a physically large terminal lock. It would be advantageous to have a terminal lock that provides increased resistance to the electric terminal being pulled out of the housing without increasing the size of the terminal cavity.

SUMMARY OF THE INVENTION

This invention relates to electric terminal housing. The electric terminal housing includes a terminal cavity. The terminal cavity extends along a cavity axis from an insertion end to a mate end. The terminal cavity is adapted to hold an electric terminal. The terminal housing includes a terminal lock. The terminal lock includes a resilient arm that extends from the housing into the terminal cavity. The terminal lock includes a rib that extends from the arm toward the cavity axis.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
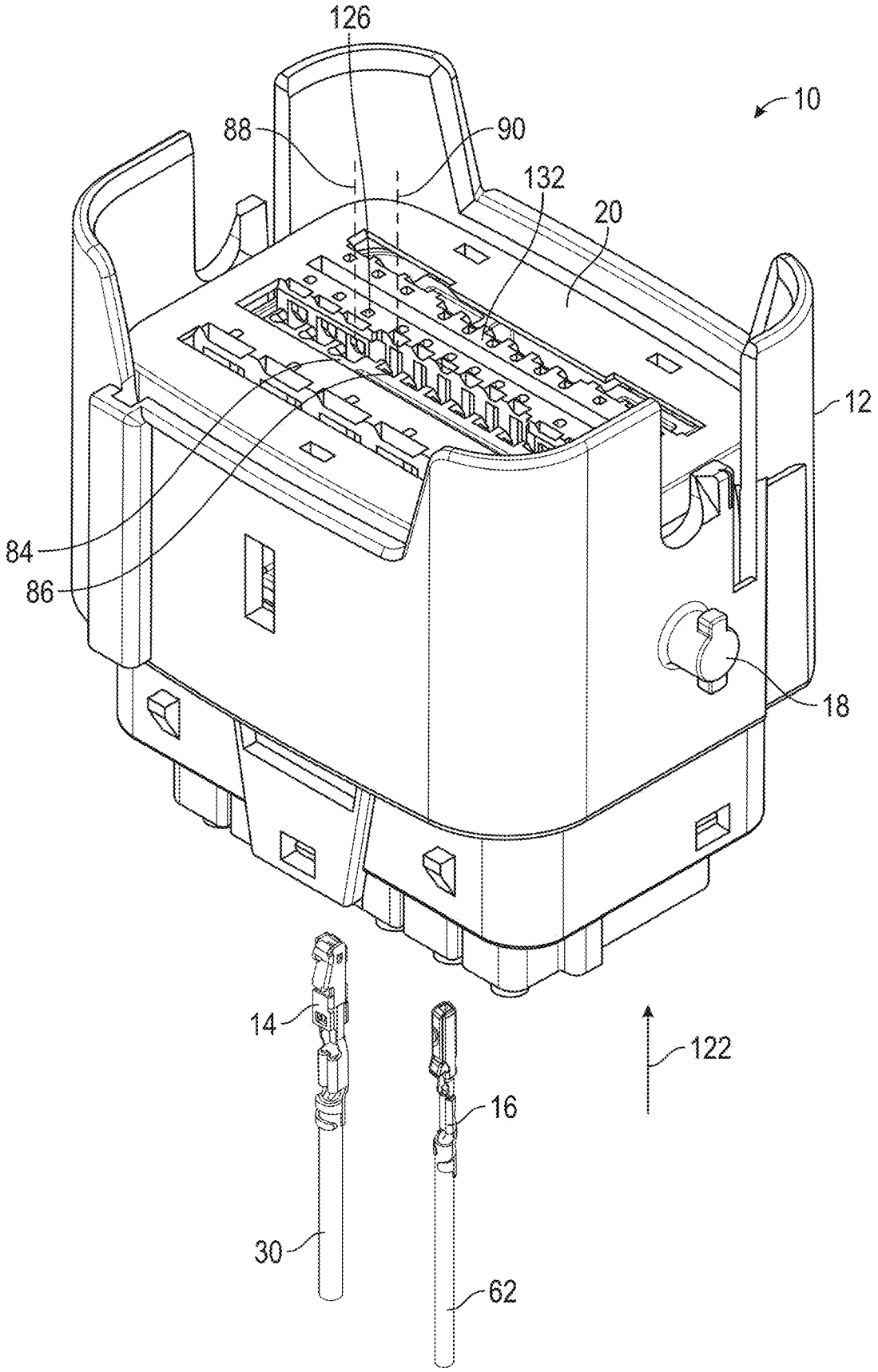
FIG. 1 is an exploded perspective view of a partially assembled electric connector.

Referring now to the drawings, there is illustrated in FIG. 1 a perspective view of an electric connector, indicated generally at 10. The electric connector 10 is part of an electric connector assembly (not shown) and is adapted to be mated with a second electric connector (not shown). An example of a similar electric connector assembly is described in U.S. Pat. No. 10,181,679, the disclosure of which is hereby incorporated by reference.

The electric connector 10 includes a housing 12. The illustrated housing 12 is molded from plastic, but may be made of any desired material and by any desired method. The electric connector 10 is adapted to hold a first electric terminal 14 and a second electric terminal 16. The illustrated electric connector 10 is adapted to hold a total of thirty electric terminals, but may hold any desired number of electric terminals. The illustrated electric connector 10 is a lever-assist connector, and the housing 12 includes two lever supports 18 (one of which is visible in FIG. 1) that are adapted to support a lever (not shown) that is used to mate the electric connector 10 with the second electric connector. However, the electric connector 10 may be any desired type of connector.

The electric connector 10 includes a terminal position assurance 20. The illustrated terminal position assurance 20 is molded from plastic, but may be made of any desired material and by any desired method. The illustrated electric connector 10 includes a single terminal position assurance 20, but may include any desired number of terminal position assurances. The terminal position assurance 20 is operable to ensure that the electric terminals are properly installed in the housing 12, as will be described below and is shown in a pre-lock position in FIG. 1.

Figure 2:
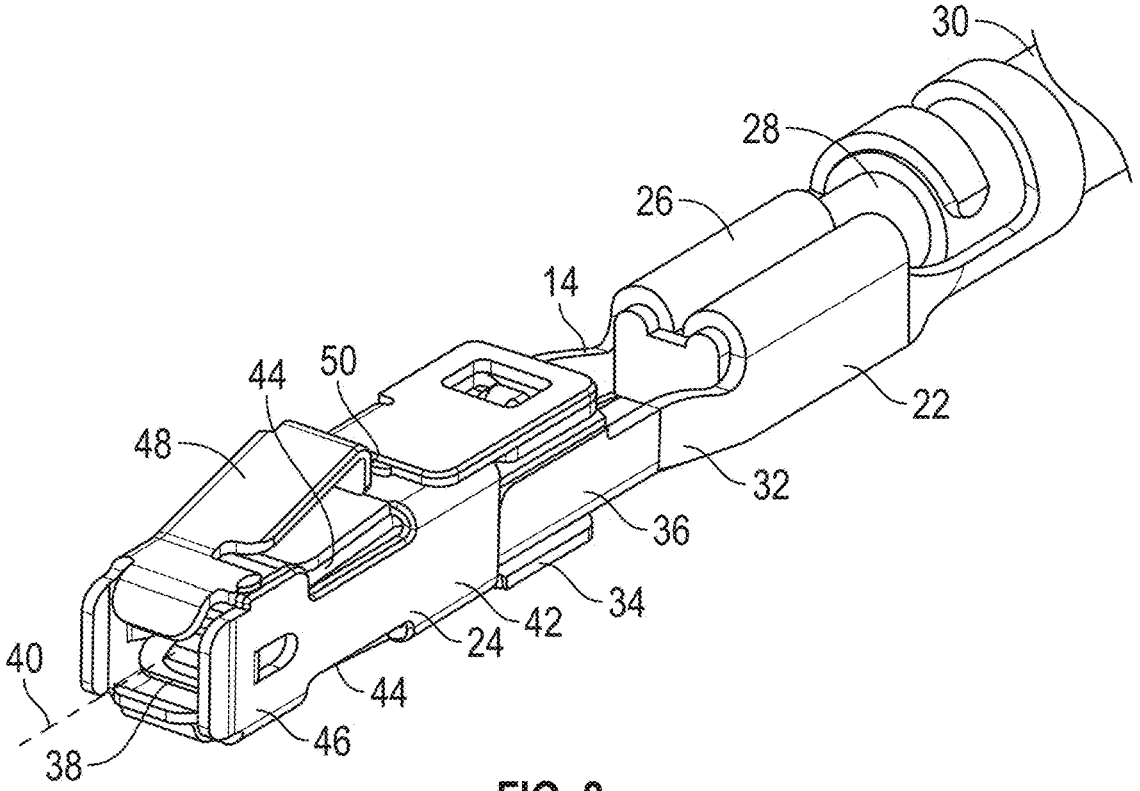
FIG. 2 is a perspective view of a first electric terminal adapted to be mounted in the electric connector.

Referring to FIG. 2, there is illustrated a perspective view of the first electric terminal 14. The illustrated first electric terminal 14 is a female electric terminal, but may be any desired type of terminal. The first electric terminal 14 includes an attachment portion 22 and a contact portion 24. The illustrated attachment portion 22 includes a crimp 26 that is attached to a conductor 28 of a first wire 30. However, the attachment portion 22 may be any desired type of connection, and may be attached to any desired conductor or component. The contact portion 24 is adapted to mate with a corresponding male electric terminal (not shown).

The illustrated first electric terminal 14 is a two-piece terminal and includes a contact member 32 and a spring 34. However, the first electric terminal 14 may be made of any desired number and arrangement of pieces. The illustrated contact member 32 is made of copper but may be made of any desired material. The contact member 32 is stamped from sheet metal and folded into the illustrated shape, but the contact member 32 may be made by any desired method.

The attachment portion 22 is part of the contact member 32, and the contact member 32 extends into the contact portion 24. The contact member 32 includes a rectangular-shaped contact box 36 and a plurality of contact arms 38 (one is visible in FIG. 2) extend from the contact box 36. The contact arms 38 are located around a first terminal axis 40 and are adapted to mate with the corresponding male terminal. In the illustrated embodiment, the corresponding male terminal is inserted along the first terminal axis 40 to mate with the first electric terminal 14, as is known in the art.

The illustrated spring 34 is made of stainless steel, but may be made of any desired material. The spring 34 is stamped from sheet metal and folded into the illustrated shape, but the spring 34 may be made by any desired method. The spring 34 includes a spring box 42 that surrounds a portion of the contact member 32. The spring 34 includes a plurality of spring arms 44 that extends from the spring box 42. The spring arms 44 are located around the first terminal axis 40 and engage the contact arms 38 to bias the contact arms 38 toward the first terminal axis 40. The spring 34 also includes a shroud 46 that is attached to the spring box 42. The shroud 46 is located around the contact arms 38 and serves to protect the contact arms 38 from damage during installation and use of the first electric terminal 14.

The first electric terminal 14 includes a lock tab 48 that defines a lock ledge 50. The lock ledge 50 is used to retain the first electric terminal 14 in the housing 12, as will be described below. The illustrated lock tab 48 is part of the spring 34, but may be part of any desired portion of the first electric terminal 14. The illustrated first electric terminal 14 is a clean body terminal and does not include a resilient locking lance. This allows the first electric terminal 14 to be inserted through a mat seal 52 (shown in FIG. 4) without causing damage to the mat seal 52.

Figure 3:
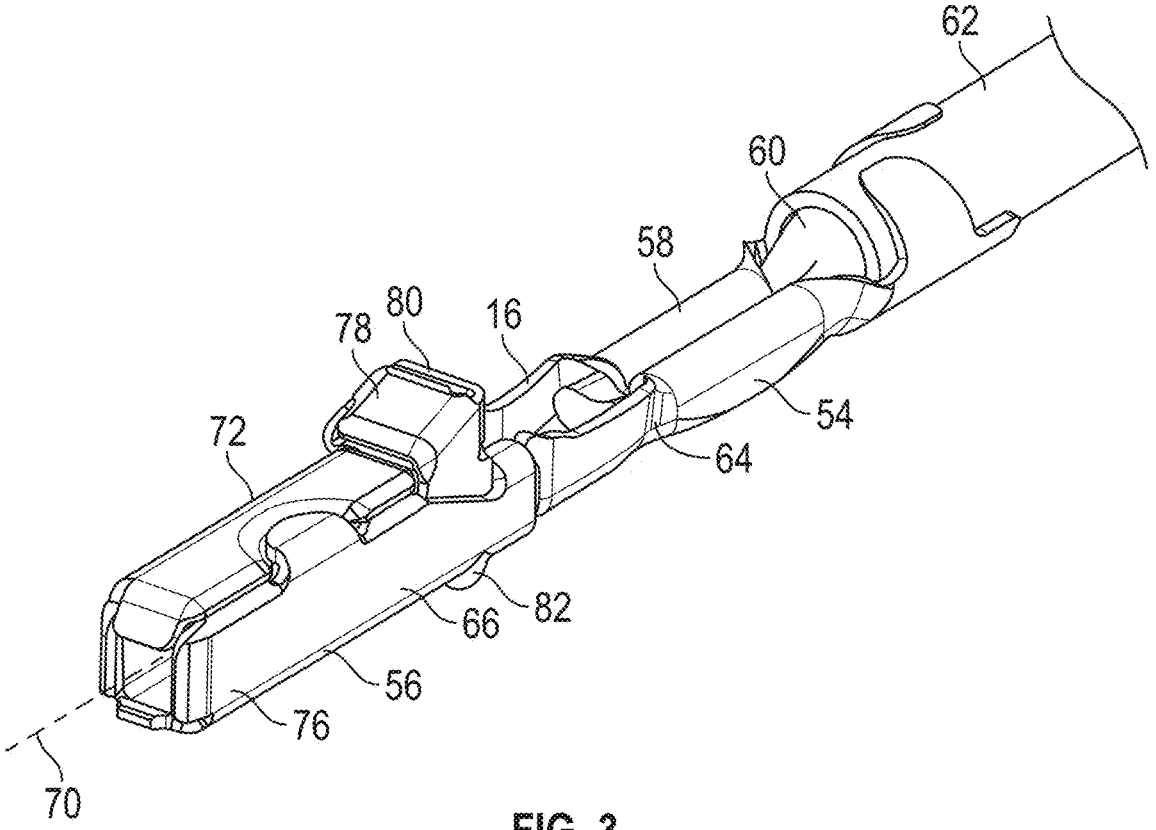
FIG. 3 is a perspective view of a second electric terminal adapted to be mounted in the electric connector.

Referring to FIG. 3, there is illustrated a perspective view of the second electric terminal 16. The illustrated second electric terminal 16 is also a female electric terminal, but may be any desired type of terminal. The second electric terminal 16 includes an attachment portion 54 and a contact portion 56. The illustrated attachment portion 54 includes a crimp 58 that is attached to a conductor 60 of a second wire 62. However, the attachment portion 54 may be any desired type of connection and may be attached to any desired conductor or component. The contact portion 56 is adapted to mate with a corresponding male electric terminal (not shown).

The illustrated second electric terminal 16 is a two-piece terminal and includes a contact member 64 and a spring 66. However, the second electric terminal 16 may be made of any desired number and arrangement of pieces. The illustrated contact member 64 is made of copper but may be made of any desired material. The contact member 64 is stamped from sheet metal and folded into the illustrated shape, but the contact member 64 may be made by any desired method.

The attachment portion 54 is part of the contact member 64, and the contact member 64 extends into the contact portion 56. The contact member 64 includes a plurality of contact arms (not shown) that are located around a second terminal axis 70 and are adapted to mate with the male corresponding terminal. In the illustrated embodiment, the corresponding terminal is inserted along the second terminal axis 70 to mate with the second electric terminal 16, as is known in the art.

The illustrated spring 66 is made of stainless steel, but may be made of any desired material. The spring 66 is stamped from sheet metal and folded into the illustrated shape, but the spring 66 may be made by any desired method. The spring 66 includes a spring box 72 that surrounds a portion of the contact member 64. The spring 66 includes a spring arm (not shown) that extends from the spring box 72. The spring arm biases the corresponding terminal into engagement with the contact arms. The spring 66 also includes a shroud 76 that is attached to the spring box 72. The shroud 76 is located around the contact arms and serves to protect the contact arms from damage during installation and use of the second electric terminal 16.

The second electric terminal 16 includes a lock tab 78 that defines a lock ledge 80. The lock ledge 80 is used to retain the second electric terminal 16 in the housing 12, as will be described below. The illustrated lock tab 78 is part of the contact member 64, but may be part of any desired portion of the second electric terminal 16. The second electric terminal 16 also includes an orientation feature 82 that extends from the spring box 72. The orientation feature 82 serves to prevent the second electric terminal 16 from being inserted into the housing 12 at an incorrect orientation relative thereto, as will be described below. The illustrated second electric terminal 16 is a clean body terminal and does not include a resilient locking lance. This allows the second electric terminal 16 to be inserted through the mat seal 52 without causing damage to the mat seal 52.

Referring back to FIG. 1, the electric connector 10 includes a first terminal cavity 84 and a second terminal cavity 86. The illustrated electric connector 10 includes a total of thirty terminal cavities, but may include any desired number of terminal cavities. The first terminal cavity 84 defines a first cavity axis 88, and the second terminal cavity 86 defines a second cavity axis 90. The first terminal cavity 84 is adapted to receive the first electric terminal 14, and the second terminal cavity 86 is adapted to receive the second electric terminal 16.

Figure 4:
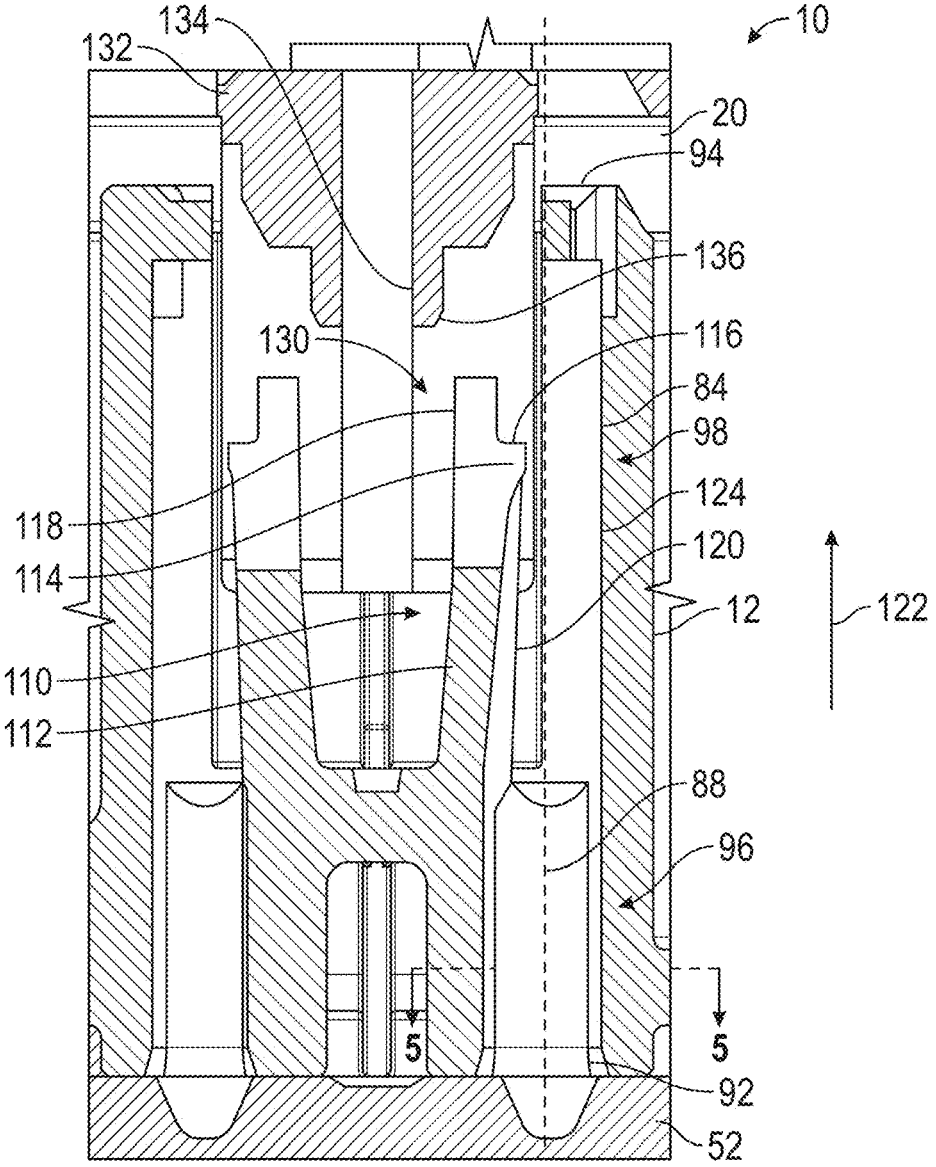
FIG. 4 is a cross-sectional view of a portion of a housing and a terminal position assurance of the electric connector, showing a first terminal cavity when the terminal position assurance is in a pre-lock position.

Referring to FIG. 4, there is illustrated a cross-sectional view of a portion of the electric connector 10 taken through the first terminal cavity 84. The cross-section is taken parallel to the first cavity axis 88. The first terminal cavity 84 extends from an insertion end 92 to a mate end 94. The first terminal cavity 84 includes an attachment cavity, indicated generally at 96, located at the insertion end 92. The attachment cavity 96 is adapted to accommodate the attachment portion 22 of the first electric terminal 14 and the attached first wire 30. The first terminal cavity 84 also includes a contact cavity, indicated generally at 98, located between the attachment cavity 96 and the mate end 94. The contact cavity 98 is adapted to accommodate the contact portion 24 of the first electric terminal 14.

Figure 5:
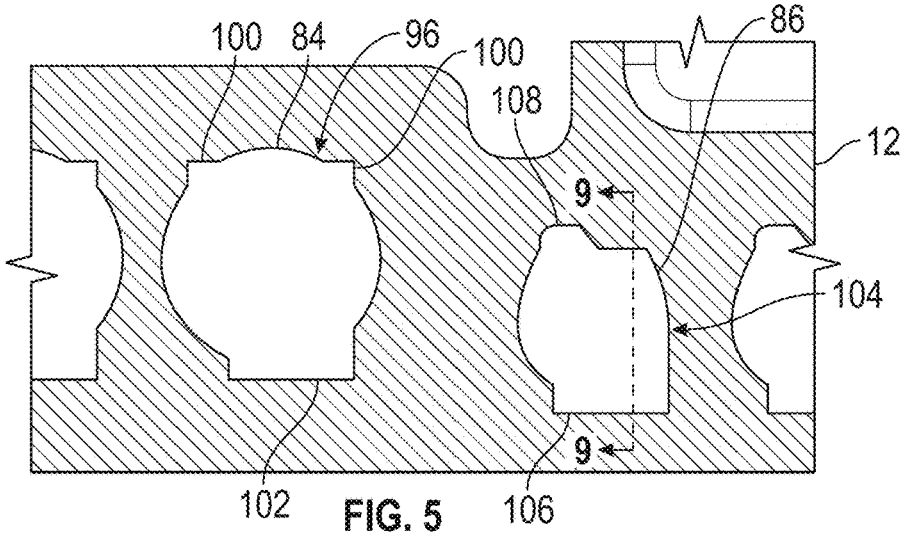
FIG. 5 is an enlarged cross-sectional view taken along line 5-5 of FIG. 4 of a portion of the housing of the electric connector showing the first terminal cavity and a second terminal cavity.

Referring to FIG. 5, there is illustrated a cross-sectional view taken along the line 5-5 of FIG. 4. The cross-section is taken through the attachment cavity 96 and perpendicular to the first cavity axis 88. The attachment cavity 96 has a substantially circular cross-sectional shape that is sized to accommodate the first wire 30. The attachment cavity 96 includes two body grooves 100 that extend outside the circular cross-section and are provided to accommodate the spring box 42 when the first electric terminal 14 is inserted into the first terminal cavity 84. The attachment cavity 96 also includes a first lock groove 102 that extends outside the circular cross-section and is provided to accommodate the lock tab 48 when the first electric terminal 14 is inserted into the first terminal cavity 84. The lock tab 48 is an orientation feature of the first electric terminal 14 that prevents the first electric terminal 14 from being inserted into the first terminal cavity 84 if the first electric terminal 14 is not oriented so that the lock tab 48 is positioned in the first lock groove 102.

FIG. 5 also illustrates a cross-sectional view of the second terminal cavity 86. The cross-section is taken through an attachment cavity 104 that is sized to accommodate the second wire 62. The second terminal cavity 86 includes a second lock groove 106 that is provided to accommodate the lock tab 78 when the second electric terminal 16 is inserted into the second terminal cavity 86. The second terminal cavity 86 also includes an orientation groove 108 that is provided to accommodate the orientation feature 82 when the second electric terminal 16 is inserted into the second terminal cavity 86. It should be appreciated that depending on the size and dimension of the second electric terminal 16, use of the orientation feature 82 may be desirable in order to prevent the second electric terminal 16 from being inserted into the second terminal cavity 86 at an undesired orientation relative thereto.

Figure 6:
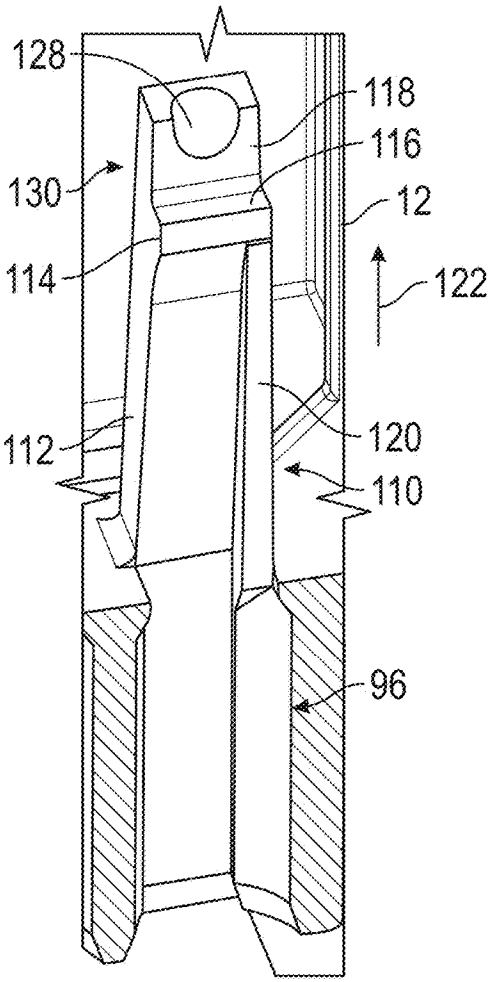
FIG. 6 is an enlarged perspective view of a terminal lock that is located in the first terminal cavity.

Referring back to FIG. 4, the first terminal cavity 84 includes a first terminal lock, indicated generally at 110, that retains the first electric terminal 14 in an installed position in the housing 12. The first terminal lock 110 is illustrated in an initial position in FIG. 4. A cut-away view of the housing 12 is illustrated in FIG. 6, showing a perspective view of the first terminal lock 110. The first terminal lock 110 includes a resilient arm 112 that extends from the housing 12 into the contact cavity 98. The arm 112 extends toward the first cavity axis 88 and toward the mate end 94 of the first terminal cavity 84. A catch 114 extends from the arm 112 toward the first cavity axis 88. The first terminal lock 110 includes a lock surface 116 located on the catch 114 adjacent to the mate end 94. As shown in FIG. 6, the illustrated lock surface 116 extends the full width of the arm 112. However, the lock surface 116 may have any desired size.

The first terminal lock 110 further includes a protrusion 118 that extends from the arm 112 toward the mate end 94. The protrusion 118 is located closer to the mate end 94 than the lock surface 116. The first terminal lock 110 also includes a rib 120 that extends from the arm 112 toward the first cavity axis 88. The rib 120 extends from the catch 114 toward the insertion end 92 and connects to the housing 12. The purpose of the protrusion 118 and the rib 120 will be described below.

Figure 7:
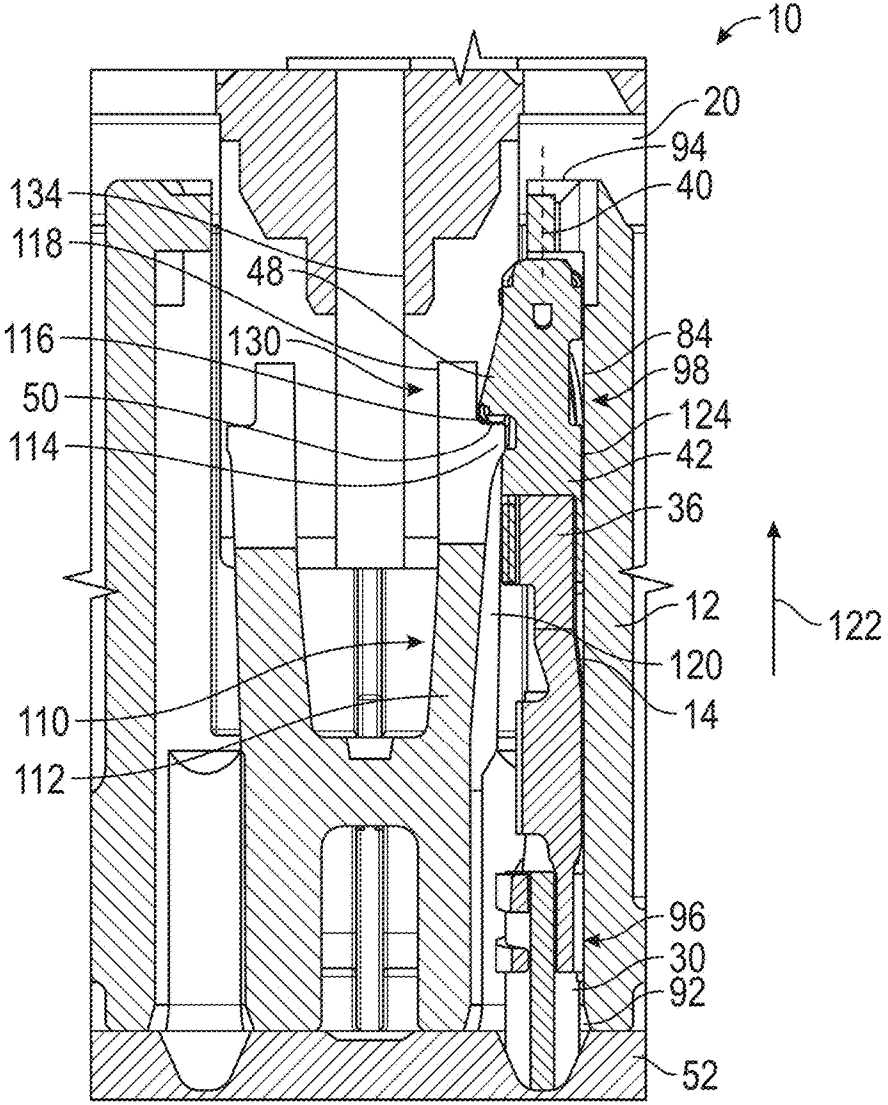
FIG. 7 is a cross-sectional view similar to FIG. 4, showing the first electric terminal located in an installed position in the first terminal cavity.

Referring to FIG. 7, there is illustrated a cross-sectional view similar to FIG. 4, showing the first electric terminal 14 in an installed position in the first terminal cavity 84. In order to insert the first electric terminal 14 into the housing 14, the first terminal axis 40 is initially aligned with the first cavity axis 88, with the contact portion 56 adjacent to the insertion end 92. The first electric terminal 14 is then moved relative to the housing 12 in an insertion direction 122 so that the contact portion 56 passes through the attachment cavity 96 and into the contact cavity 98. If the first electric terminal 14 is in an improper orientation relative to the housing 12, either the shroud 46 or the lock tab 48 will engage a wall of the first terminal cavity 84 to prevent further movement of the first electric terminal 14 in the insertion direction 122. When the first electric terminal 14 is properly oriented relative to the housing 12, the lock tab 48 is aligned with the first lock groove 102, and the first electric terminal 14 can be moved in the insertion direction 122 relative to the housing 12 until the first electric terminal 14 is located in the installed position.

When the first electric terminal 14 is inserted into the housing 12 and is moved in the insertion direction 122 toward the installed position, the lock tab 48 initially engages the rib 120. The engagement with the rib 120 serves to rotate the first electric terminal 14 relative to the first terminal axis 40 so that the first electric terminal 14 is properly oriented in the first terminal cavity 84. As the first electric terminal 14 is moved farther in the insertion direction 122, the lock tab 48 engages the catch 114 and the contact portion 24 engages the rib 120, and this engagement deflects the arm 112 and moves the catch 114 away from the first cavity axis 88. When the lock tab 48 has been moved in the insertion direction 122 past the catch 114, the arm 112 will rebound, causing the catch 114 to move back toward the first cavity axis 88. As shown in FIG. 7, the protrusion 118 on the first terminal lock 110 engages the lock tab 48 to limit the amount of rebounding movement of the catch 114 toward the first cavity axis 88. The first terminal lock 110 is then in a locked position. When the first terminal lock 110 is in the locked position, the catch 114 is located farther away from the first cavity axis 88 than when the first terminal lock 110 is in the initial position. Thus, the arm 112 remains stressed and applies a force to the first electric terminal 14, pressing the first electric terminal 14 against an opposed wall 124 of the first terminal cavity 84 that is located opposite the first lock groove 102.

When the arm 112 rebounds toward the first cavity axis 88, the rib 120 is moved into engagement with the first electric terminal 14. As shown in FIG. 7, the rib 120 engages a portion of the spring box 42, and portions of the spring box 42 are located between the rib 120 and the opposed wall 124. Additionally, portions of the contact box 36 are located between the rib 120 and the opposed wall 124. As previously described, the arm 112 remains stressed when the first terminal lock 110 is in the locked position. Thus, the first terminal lock 110 applies a force to the contact box 36 and the spring box 42 when the first terminal lock 110 is in the locked position. This force helps to prevent deformation of the first electric terminal 14, as will be described below.

When the first terminal lock 110 is in the locked position, the lock surface 116 is located opposite the insertion direction 122 of the lock tab 48. If a force is applied to the first electric terminal 14 to pull it out of the first terminal cavity 84, the lock tab 48 will engage the lock surface 116, and the first terminal lock 110 will resist movement of the first electric terminal 14. Thus, the lock tab 48 acts as both an orientation feature, to ensure that the first electric terminal 14 is properly oriented in the first terminal cavity 84, and as a lock feature, to ensure that the first electric terminal 14 remains in the installed position in the first terminal cavity 84.

When the first terminal lock 110 is in the locked position, the lock surface 116 on the catch 114 extends from the arm 112 toward the first cavity axis 88 and toward the insertion end 92 of the first terminal cavity 84. Thus, the lock surface 116 extends at an angle relative to the first cavity axis 88 that causes the arm 112 to be pulled into the first electric terminal 14 when the force is applied to pull the first electric terminal 14 out of the first terminal cavity 84. As previously described, the protrusion 118 and the rib 120 on the first terminal lock 110 engage the first electric terminal 14 to limit movement of the arm 112 toward the first cavity axis 88. As a result, when the force is applied to pull the first electric terminal 14 out of the first terminal cavity 84, the first electric terminal 14 will be pinched in place in the first terminal cavity 84 by the first terminal lock 110. Because the arm 112 is pulled into the first electric terminal 14, the first electric terminal 14 will not slip off the end of the lock surface 116.

The shear strength of the material comprising the catch 114 resists movement of the first electric terminal 14 out of the first terminal cavity 84. The rib 120 extends from the catch 114 toward the insertion end 92 and increases the strength of the catch 114. The rib 120 is advantageous over making the entire arm 112 larger because the amount of force necessary to deflect the arm 112 from the initial position (shown in FIG. 4) during insertion of the first electric terminal 14 may become undesirably large if the arm 112 is made larger.

As previously described, the first terminal lock 110 applies a force to the first electric terminal 14 to prevent deformation of the first electric terminal 14. When the force is applied to pull the first electric terminal 14 out of the first terminal cavity 84 and movement of the first electric terminal 14 is resisted by the first terminal lock 110, the first electric terminal 14 may deform under the force if the magnitude of the force is large enough. By pinching the first electric terminal 14 between the rib 120 and the opposed wall 124, the first terminal lock 110 prevents the first electric terminal 14 from deforming under this applied force.

The illustrated housing 12 is serviceable, and the first electric terminal 14 may be removed from the installed position, if desired. The housing 12 includes a release opening 126 (shown in FIG. 1) that allows a release tool (not shown) to be inserted in order to move the first terminal lock 110 from the locked position to a release position. The illustrated release opening 126 is located in the terminal position assurance 20 at an end of the first lock groove 102 that is adjacent to the mate end 94 of the first terminal cavity 84. The first terminal lock 110 includes a release surface 128 (best shown in FIG. 6) that is located on the arm 112. The release surface 128 extends at an angle relative to the first cavity axis 88 so that the release tool may be inserted through the release opening 126, engage the release surface 128, and push the arm 112 into a clear space 130 that is located on a side of the arm 112 opposite the first cavity axis 88, which will push the catch 114 away from the first cavity axis 88. With the first electric terminal 14 in the release position, the first electric terminal 14 may be removed from the first terminal cavity 84.

As illustrated in FIG. 7, the terminal position assurance 20 is shown in the pre-lock position. The terminal position assurance 20 includes a terminal position assurance body 132 and a plurality of lock stops 134. Each of the lock stops 134 serves to prevent movement of one terminal lock, and the lock stop 134 that prevents movement of the first terminal lock 110 will be described in detail below. The illustrated terminal position assurance 20 includes thirty lock stops 134, but may include any desired number.

Figure 8:
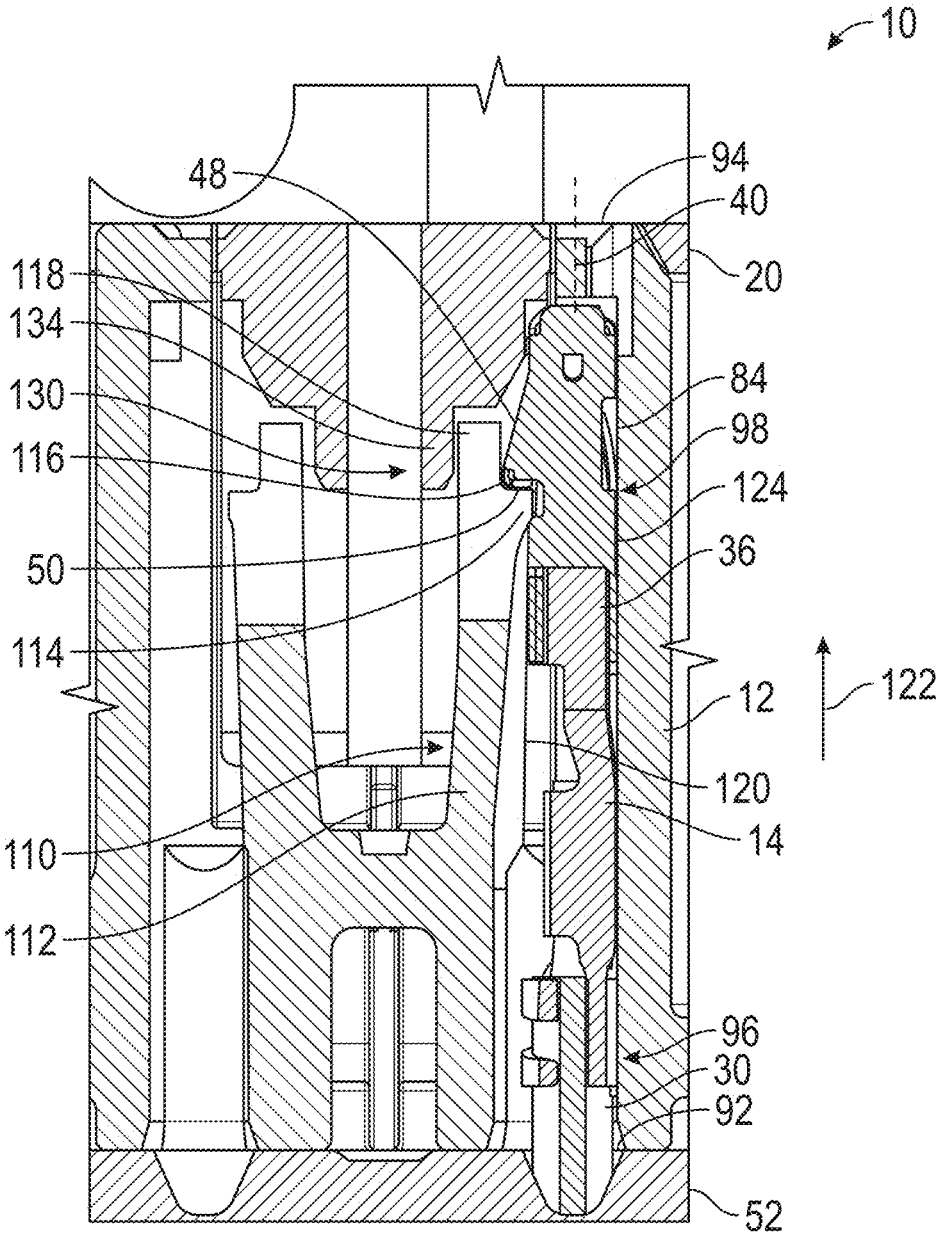
FIG. 8 is a cross-sectional view similar to FIG. 7, showing the terminal position assurance located in a locked position.

Referring to FIG. 8, there is illustrated a cross-sectional view similar to FIG. 7, with the terminal position assurance 20 shown in a locked position. As shown, the lock stop 134 is located adjacent to the first terminal lock 110 in the clear space 130. Thus, when located in the locked position, the terminal position assurance 20 prevents the first terminal lock 110 from being moved to the release position. In order to move the terminal position assurance 20 from the pre-lock position (shown in FIG. 7) to the locked position (shown in FIG. 8), the illustrated terminal position assurance 20 is moved relative to the housing 12 opposite the insertion direction 122. However, the terminal position assurance 20 may be adapted to be moved in any desired direction relative to the housing 12.

The illustrated lock stop 134 includes a bevel 136 that extends at an angle between the lock stop 134 and the first terminal lock 110. When the terminal position assurance 20 is moved from the pre-lock position to the locked position, the lock stop 134 enters the clear space 130 with an initial distance between the lock stop 134 and the first terminal lock 110. As the terminal position 20 is moved toward the locked position, the distance between the lock stop 134 and the first terminal lock 110 decreases. In the illustrated embodiment, when the terminal position assurance 20 is in the locked position, the lock stop 134 engages the first terminal lock 110 and pushes the first terminal lock 110 toward the first cavity axis 88. The bevel 136 allows the terminal position assurance 20 to be moved to the locked position and to adjust any rotation of the first terminal lock 110. For example, the first terminal lock 110 may be rotated about an axis that is parallel to the arm 112 when the first electric terminal 14 is in the installed position due to the rib 120 engaging the first electric terminal 14. The bevel 136 allows the lock stop 134 to move into the clear space 130 regardless of the rotation of the first terminal lock 110. Further, when the terminal position assurance 20 is in the locked position, the lock stop 134 engages to the first terminal lock 110 to straighten out the rotation of the first terminal lock 110.

Figure 9:
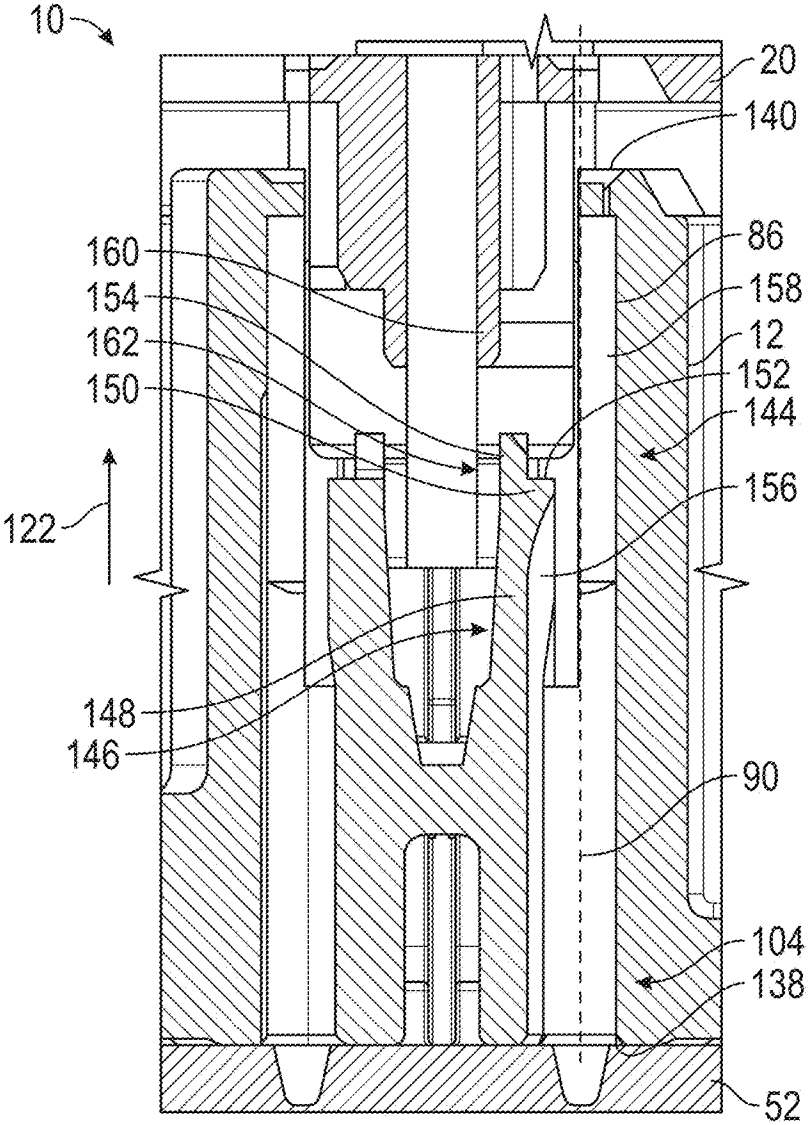
FIG. 9 is a cross-sectional view of the second terminal cavity taken along line 9-9 of FIG. 5.

Referring now to FIG. 9, there is illustrated a cross-sectional view of a portion of the housing 12 taken along the line 9-9 of FIG. 5 through the second terminal cavity 86. The cross-section is taken parallel to the second cavity axis 90. The second terminal cavity 86 extends from an insertion end 138 to a mate end 140. The second terminal cavity 86 includes the attachment cavity 104 located at the insertion end 138. The attachment cavity 104 is adapted to accommodate the attachment portion 54 of the second electric terminal 16 and the attached second wire 62. The second terminal cavity 86 also includes a contact cavity, indicated generally at 144, located between the attachment cavity 104 and the mate end 140. The contact cavity 144 is adapted to accommodate the contact portion 56 of the second electric terminal 16.

The second terminal cavity 86 includes a second terminal lock, indicated generally at 146, that retains the second electric terminal 16 in an installed position in the housing 12. The second terminal lock 146 is illustrated in an initial position in FIG. 9. The second terminal lock 146 includes a resilient arm 148 that extends from the housing 12 into the contact cavity 144. The arm 148 extends toward the second cavity axis 90 and toward the mate end 140 of the second terminal cavity 86. A catch 150 extends from the arm 148 toward the second cavity axis 90. The second terminal lock 146 also includes a lock surface 152 located on the catch 150 adjacent to the mate end 140. The illustrated lock surface 152 extends the full width of the arm 148. However, the lock surface 152 may have any desired size.

The second terminal lock 146 includes a protrusion 154 that extends from the arm 148 toward the mate end 140 and which is located closer to the mate end 140 than the lock surface 152. The second terminal lock 146 also includes a rib 156 that extends from the arm 148 toward the second cavity axis 90. The rib 156 extends from the catch 150 toward the insertion end 138 and connects to the housing 12.

Figure 10:
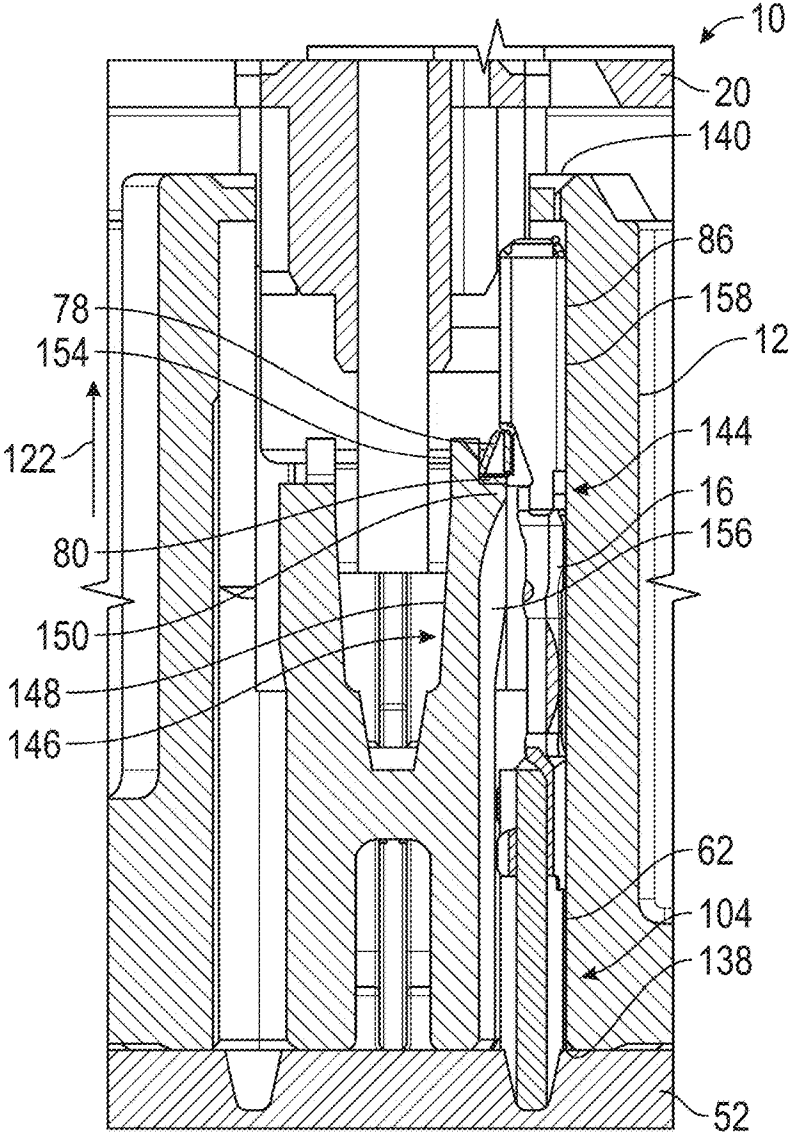
FIG. 10 is a cross-sectional view of the second terminal cavity when the second electric terminal is installed therein.

Referring to FIG. 10, there is illustrated a cross-sectional view similar to FIG. 9, showing the second electric terminal 16 in an installed position in the second terminal cavity 86. The second electric terminal 16 is installed in the housing 12 in a manner similar to how the first electric terminal 14 is installed. When the second electric terminal 16 is installed in the second terminal cavity 86, the lock tab 78 is located in the second lock groove 106, and the orientation feature 82 is located in the orientation groove 108.

When the second electric terminal 16 is inserted into the housing 12 and moved in the insertion direction 122 toward the installed position, the lock tab 78 initially engages the rib 156 and deflects the arm 148, which moves the catch 150 away from the second cavity axis 90. When the lock tab 78 has been moved in the insertion direction 122 past the catch 150, the arm 148 will rebound, causing the catch 150 to move back toward the second cavity axis 90. The protrusion 154 on the second terminal lock 146 engages the lock tab 78 to limit the amount of rebounding movement of the catch 150 toward the second cavity axis 90. The second terminal lock 146 is then in a locked position. When the second terminal lock 146 is in the locked position, the catch 150 is located farther away from the second cavity axis 90 than when the second terminal lock 146 is in the initial position. Thus, the arm 148 remains stressed and applies a force to the second electric terminal 16, pressing the second electric terminal 16 against an opposed wall 158 of the second terminal cavity 86 that is located opposite the lock groove 106.

When the second terminal lock 146 is in the locked position, the lock surface 152 is located opposite the insertion direction 122 of the lock tab 78. If a force is applied to the second electric terminal 16 to pull it out of the second terminal cavity 86, the lock tab 78 will engage the lock surface 152, and the second terminal lock 146 will resist movement of the second electric terminal 16.

Figure 11:
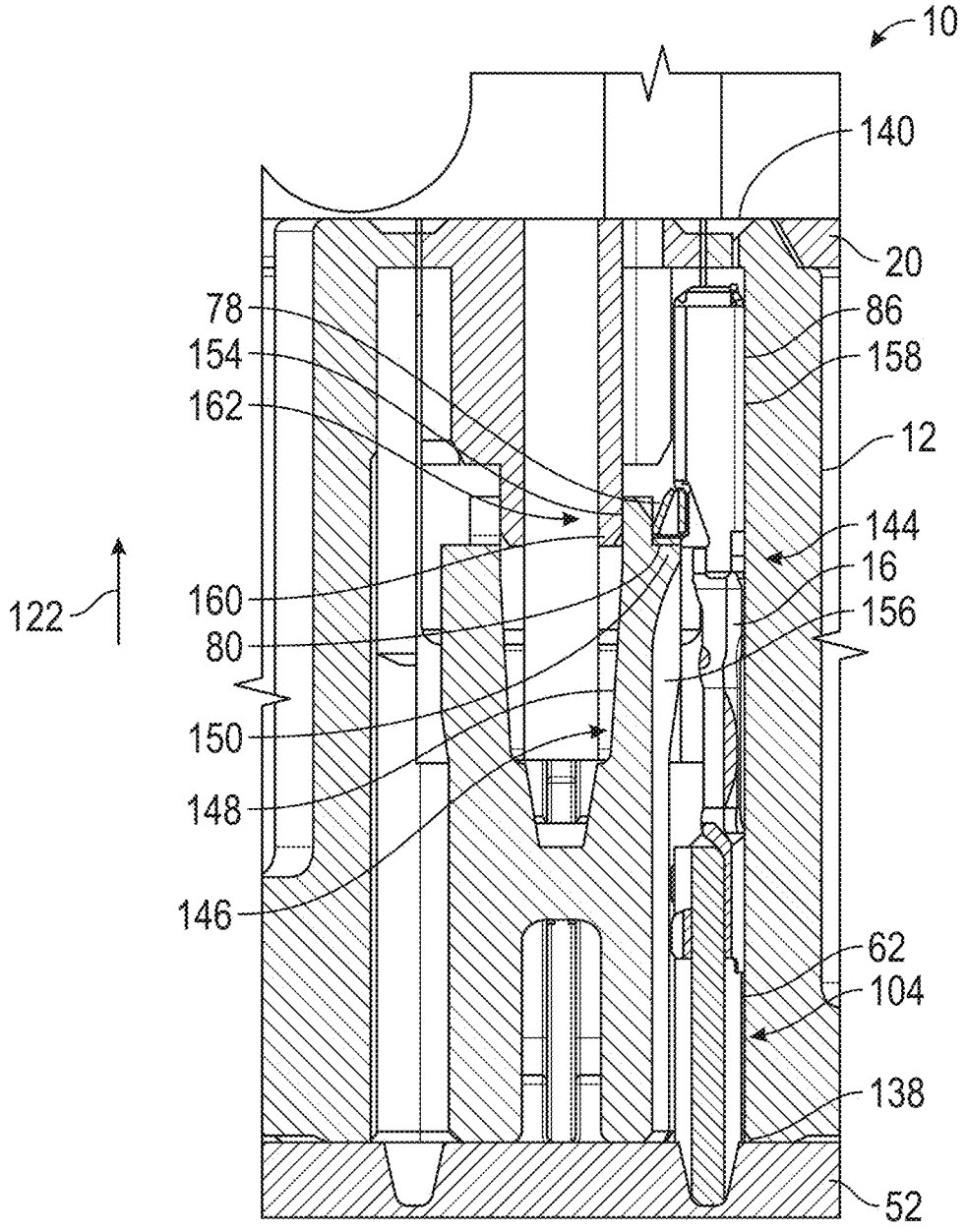
FIG. 11 is a cross-sectional view of the second terminal cavity when the terminal position assurance is in the locked position.

Referring to FIG. 11, there is illustrated a cross-sectional view similar to FIG. 10, with the terminal position assurance 20 shown in the locked position. As shown, a lock stop 160 is located adjacent to the second terminal lock 146 in a clear space 162. Thus, when the terminal position assurance 20 in the locked position, the second terminal lock 146 is prevented from being moved to a release position.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electric connector housing comprising:

a housing defining a terminal cavity; and a terminal lock including:

an arm that extends from the housing to an end that is located within the terminal cavity;

a catch that extends from the end of the arm farther into the terminal cavity than the end of the arm; and a rib that extends along the arm from the housing to the catch farther into the terminal cavity than the arm, wherein:

the terminal cavity of the housing is adapted to receive an electric terminal therein, and the catch of the terminal lock is adapted to engage and retain the electric terminal within the terminal cavity of the housing.

2. The electric connector housing defined in claim 1 wherein the terminal lock further includes a protrusion that extends from the end of the arm farther beyond the catch, and wherein the protrusion has a concavely-shaped release surface provided therein.

3. The electric connector housing defined in claim 1 wherein the terminal cavity defines a cavity axis, the catch extends from the end of the arm toward the cavity axis, and the rib extends along the arm from the housing to the catch toward the cavity axis.

4. The electric connector housing defined in claim 3 wherein the terminal lock further includes a protrusion that extends from the end of the arm farther beyond the catch, and wherein the protrusion has a concavely-shaped release surface provided therein that extends at an angle relative to the cavity axis.

5. The electric connector housing defined in claim 1 wherein the housing defines a plurality of terminal cavities and includes a plurality of terminal locks, wherein each of the plurality of terminal locks includes:

an arm that extends from the housing to an end that is located within an associated one of the plurality of terminal cavities;

a catch that extends from the end of the arm farther into the associated one of the plurality of terminal cavities than the end of the arm; and a rib that extends along the arm from the housing to the catch farther into the associated one of the plurality of terminal cavities than the arm, wherein:

each of the plurality of terminal cavities of the housing is adapted to receive an associated electric terminal therein, and the catch of each of the plurality of terminal locks is adapted to engage and retain the associated electric terminal within the associated one of the plurality of terminal cavities of the housing.

6. The electric connector housing defined in claim 5 wherein each of the plurality of terminal locks further includes a protrusion that extends from the end of the arm farther beyond the catch.

7. The electric connector housing defined in claim 6 wherein each of the protrusions has a concavely-shaped release surface provided therein.

8. The electric connector housing defined in claim 5 wherein the each of the plurality of terminal cavities defines a cavity axis, each of the catches extends from the end of the arm toward the cavity axis, and each of the ribs extends along the arm from the housing to the catch toward the cavity axis.

9. The electric connector housing defined in claim 8 wherein each of the plurality of terminal locks further includes a protrusion that extends from the end of the arm farther beyond the catch.

10. The electric connector housing defined in claim 9 wherein each of the protrusions has a concavely-shaped release surface provided therein that extends at an angle relative to the cavity axis.

11. An electric connector comprising:

a housing defining a terminal cavity and including a terminal lock having:

an arm that extends from the housing to an end that is located within the terminal cavity;

a catch that extends from the end of the arm farther into the terminal cavity than the end of the arm; and a rib that extends along the arm from the housing to the catch farther into the terminal cavity than the arm; and an electric terminal disposed within the terminal cavity of the housing such that the catch of the terminal lock engages and retains the electric terminal within the terminal cavity of the housing.

12. The electric connector housing defined in claim 1 wherein the terminal lock further includes a protrusion that extends from the end of the arm farther beyond the catch, and wherein the protrusion has a concavely-shaped release surface provided therein.

13. The electric connector housing defined in claim 1 wherein the terminal cavity defines a cavity axis, the catch extends from the end of the arm toward the cavity axis, and the rib extends along the arm from the housing to the catch toward the cavity axis.

14. The electric connector housing defined in claim 13 wherein the terminal lock further includes a protrusion that extends from the end of the arm farther beyond the catch, and wherein the protrusion has a concavely-shaped release surface provided therein that extends at an angle relative to the cavity axis.

15. The electric connector housing defined in claim 1 wherein the housing defines a plurality of terminal cavities and includes a plurality of terminal locks that engage and retain respective electric terminals disposed within associated ones of the plurality of terminal cavities, wherein each of the plurality of terminal locks includes:

an arm that extends from the housing to an end that is located within an associated one of the plurality of terminal cavities;

a catch that extends from the end of the arm farther into the associated one of the plurality of terminal cavities than the end of the arm; and a rib that extends along the arm from the housing to the catch farther into the associated one of the plurality of terminal cavities than the arm, wherein:

each of the plurality of terminal cavities of the housing receives an associated electric terminal therein, and the catch of each of the plurality of terminal locks engages and retains the associated electric terminal within the associated one of the plurality of terminal cavities of the housing.

16. The electric connector housing defined in claim 15 wherein each of the plurality of terminal locks further includes a protrusion that extends from the end of the arm farther beyond the catch.

17. The electric connector housing defined in claim 16 wherein each of the protrusions has a concavely-shaped release surface provided therein.

18. The electric connector housing defined in claim 15 wherein the each of the plurality of terminal cavities defines a cavity axis, each of the catches extends from the end of the arm toward the cavity axis, and each of the ribs extends along the arm from the housing to the catch toward the cavity axis.

19. The electric connector housing defined in claim 18 wherein each of the plurality of terminal locks further includes a protrusion that extends from the end of the arm farther beyond the catch.

20. The electric connector housing defined in claim 19 wherein each of the protrusions has a concavely-shaped release surface provided therein that extends at an angle relative to the cavity axis.

* * * * *